US011684947B2

(12) United States Patent
Graff

(10) Patent No.: US 11,684,947 B2
(45) Date of Patent: Jun. 27, 2023

(54) MODULAR FLUID APPLICATION DEVICE FOR VARYING FLUID COAT WEIGHT

(71) Applicant: Illinois Tool Works Inc., Glenview, IL (US)

(72) Inventor: Christopher Scott Rank Graff, Tacoma, WA (US)

(73) Assignee: Illinois Tool Works Inc., Glenview, IL (US)

( * ) Notice: Subject to any disclaimer, the term of this patent is extended or adjusted under 35 U.S.C. 154(b) by 58 days.

(21) Appl. No.: 17/284,839

(22) PCT Filed: Nov. 7, 2019

(86) PCT No.: PCT/US2019/060297
§ 371 (c)(1),
(2) Date: Apr. 13, 2021

(87) PCT Pub. No.: WO2020/097354
PCT Pub. Date: May 14, 2020

(65) Prior Publication Data

US 2021/0387225 A1 Dec. 16, 2021

Related U.S. Application Data

(60) Provisional application No. 62/758,078, filed on Nov. 9, 2018.

(51) Int. Cl.
*B05C 11/10* (2006.01)
*B05B 15/40* (2018.01)
*B05C 5/02* (2006.01)

(52) U.S. Cl.
CPC ..... *B05C 11/1036* (2013.01); *B05B 15/40* (2018.02); *B05C 5/0241* (2013.01);
(Continued)

(58) Field of Classification Search
None
See application file for complete search history.

(56) References Cited

U.S. PATENT DOCUMENTS 2,396,449 A * 3/1946 Fredw ..... B05B 1/14 239/460
3,053,223 A * 9/1962 Hensen ..... B05B 13/0278 118/610

(Continued)

FOREIGN PATENT DOCUMENTS

GB 938031 A 9/1963

OTHER PUBLICATIONS

Written Opinion issued by ISA/EPO in connection with PCT/US2019/060297 dated May 8, 2020.

(Continued)

*Primary Examiner* — Jethro M. Pence
(74) *Attorney, Agent, or Firm* — Levenfeld Pearlstein, LLC

(57) ABSTRACT

A modular fluid application device (10) includes a module base (12) and first and second fluid passageways extending within the module base and intersecting to form a nozzle fluid supply passageway. The modular fluid application device also includes a fluid outlet (22) formed on a nozzle mounting surface (24) of the module base fluidically connected to the nozzle fluid supply passageway, a base air passageway extending in the module base and an air outlet formed on the nozzle mounting surface fluidically connected to the base air passageway. A first module bank (14) is removably mounted on the module base and includes at least one first module having a first valve configured to control a flow of fluid in the first fluid passageway. A second module bank (18) is removably mounted on the module base and includes at least one second module having a second valve configured to control a flow of fluid in the second fluid (Continued)

passageway. The first module and the second module are mounted at an angle relative to one another.

10 Claims, 5 Drawing Sheets

(52) U.S. Cl.
CPC ..... *B05C 5/0279* (2013.01); *B05C 11/1028* (2013.01); *B05C 11/1042* (2013.01)

(56) References Cited

U.S. PATENT DOCUMENTS 3,332,581 A * 7/1967 Eastabrooks ..... B05C 5/001 222/509
3,792,801 A * 2/1974 Baker ..... B29B 13/022 392/471
3,847,118 A * 11/1974 Ambry ..... B05B 14/48 118/DIG. 7
3,850,679 A * 11/1974 Sopko ..... C23C 16/545 427/255.31
3,888,649 A * 6/1975 Simhan ..... C23C 16/545 65/60.52
3,942,469 A * 3/1976 Simhan ..... C03C 17/245 118/729
3,951,100 A * 4/1976 Sopko ..... C23C 16/40 118/729
3,970,037 A * 7/1976 Sopko ..... C23C 16/453 118/729
4,298,633 A * 11/1981 Bradlee ..... B65H 35/02 427/178
4,687,137 A * 8/1987 Boger ..... B05C 5/0279 118/325
4,874,451 A * 10/1989 Boger ..... B05C 5/001 156/324
4,919,072 A * 4/1990 Claasen ..... B05C 11/10 403/324
4,989,792 A * 2/1991 Claassen ..... B05B 1/306 239/586
5,100,699 A * 3/1992 Roeser ..... B29B 7/749 427/256
5,195,656 A * 3/1993 Briehl ..... G01F 11/021 222/340
5,257,723 A * 11/1993 Bagung ..... B67D 7/645 222/146.2
5,269,670 A * 12/1993 Allen ..... B29C 48/345 425/464
5,401,899 A * 3/1995 Bryant ..... D21H 23/22 118/608
5,453,302 A * 9/1995 Chaudhry ..... B05D 7/146 118/421
5,480,487 A * 1/1996 Figini ..... B01D 19/0036 96/194
5,605,720 A * 2/1997 Allen ..... B05C 5/0279 427/430.1
5,618,566 A * 4/1997 Allen ..... B05C 5/0279 425/464
5,656,090 A * 8/1997 Preston ..... B05C 11/10 137/625.11
5,680,961 A * 10/1997 Boccagno ..... B29B 13/022 222/129
5,699,938 A * 12/1997 Siddiqui ..... B29B 13/022 219/421
5,728,219 A * 3/1998 Allen ..... B05C 5/0279 425/464
5,766,359 A * 6/1998 Sichmann ..... B05C 11/10 118/321
5,832,178 A * 11/1998 Schave ..... H05B 3/40 388/934
5,862,986 A * 1/1999 Bolyard, Jr. ..... B05B 7/164 239/128
5,974,227 A * 10/1999 Schave ..... B05C 11/1042 392/479
6,049,658 A * 4/2000 Schave ..... E01C 19/45 392/471
6,089,413 A * 7/2000 Riney ..... B05B 7/0861 222/504
6,168,049 B1 * 1/2001 Bolyard, Jr. ..... B05B 15/40 222/189.06
6,210,141 B1 * 4/2001 Allen ..... B05C 5/0279 425/188
6,220,843 B1 * 4/2001 Allen ..... B05C 5/001 425/7
6,296,463 B1 * 10/2001 Allen ..... D01D 5/0985 425/7
6,318,599 B2 * 11/2001 Estelle ..... G05D 23/1919 239/585.4
6,322,630 B1 * 11/2001 Carroll ..... B05C 5/0241 118/681
6,341,719 B2 * 1/2002 Villa ..... B05C 11/101 222/134
6,368,409 B1 * 4/2002 Borsuk ..... B05B 5/088 118/623
6,380,861 B2 * 4/2002 Estelle ..... B05C 5/0237 340/595
6,401,976 B1 * 6/2002 Estelle ..... G05D 23/1919 165/269
6,457,608 B1 * 10/2002 Riney ..... B05C 5/0279 239/564
6,460,731 B2 * 10/2002 Estelle ..... G05D 23/1919 340/595
6,488,772 B2 * 12/2002 Falck ..... B05C 11/1042 184/102
6,488,846 B1 * 12/2002 Marangi ..... B01D 35/0276 239/149
6,503,362 B1 * 1/2003 Bartels ..... B05B 7/0425 128/200.22
6,508,414 B2 * 1/2003 Matsumoto ..... B05B 15/40 239/284.1
6,514,569 B1 * 2/2003 Crouch ..... F04B 1/122 222/134
6,520,382 B2 * 2/2003 Estelle ..... B05C 5/001 222/146.1
6,641,670 B2 * 11/2003 Tsujii ..... C03C 17/001 118/410
6,695,923 B1 * 2/2004 Schultz ..... B05B 13/0431 118/679
6,695,962 B2 * 2/2004 Uzoh ..... C25D 5/08 204/266
6,736,900 B2 * 5/2004 Isogai ..... F04C 11/005 222/413
6,783,803 B2 * 8/2004 Tsujii ..... C03C 17/001 427/256
6,802,903 B2 * 10/2004 Barber ..... B05C 5/0287 118/220
6,809,294 B2 * 10/2004 Velinsky ..... B05C 11/1042 404/107
6,836,616 B2 * 12/2004 Jamison ..... B05C 11/1042 392/471
6,911,232 B2 * 6/2005 Crane ..... B05C 5/0241 118/325
7,032,789 B2 * 4/2006 Gabryszewski ..... B05C 5/0225 222/504
RE39,399 E * 11/2006 Allen ..... D01D 4/025 425/7
7,144,442 B2 * 12/2006 Hayashi ..... B01D 19/0021 95/266
7,214,907 B2 * 5/2007 Velinsky ..... B05C 5/02 404/107
7,216,777 B2 * 5/2007 Raterman ..... B05C 11/10 222/23
7,246,615 B2 * 7/2007 Bartels ..... F15C 1/22 128/200.22
7,296,707 B2 * 11/2007 Raines ..... B05C 5/001 222/387
7,316,331 B2 * 1/2008 Gabryszewski .... B05C 11/1042 222/23

(56) References Cited

U.S. PATENT DOCUMENTS 7,332,035 B1 * 2/2008 Tudor ..... B05C 5/0279 118/323
7,427,424 B2 * 9/2008 Hill ..... B05C 5/0279 118/632
7,584,908 B2 * 9/2009 Swan ..... B05B 15/40 239/523
7,647,885 B2 * 1/2010 Crane ..... B05D 5/00 118/313
7,703,706 B2 * 4/2010 Walker ..... B05B 1/265 239/487
7,731,647 B2 * 6/2010 Duwendag ..... B05C 11/10 493/264
7,770,760 B2 * 8/2010 McGuffey ..... B05C 11/1042 137/884
7,874,456 B2 * 1/2011 Bolyard, Jr. ..... B05C 11/1042 222/61
7,913,937 B2 * 3/2011 Kioi ..... B05B 1/3402 239/592
7,950,346 B2 * 5/2011 Crane ..... B05D 5/00 118/62
8,033,243 B2 * 10/2011 Bolyard, Jr. ..... B65H 57/16 118/325
8,171,876 B2 * 5/2012 Namekawa ..... B41J 2/18 347/85
8,366,020 B2 * 2/2013 Wang ..... B05B 3/0422 239/200
8,367,154 B2 * 2/2013 Yanagawa ..... B05C 5/0225 427/117
8,413,848 B2 * 4/2013 McGuffey ..... B05C 5/0279 239/548
8,445,061 B2 * 5/2013 McGuffey ..... B05C 5/0225 222/61
8,534,574 B2 * 9/2013 Simion ..... B05C 5/0225 222/509
8,596,555 B2 * 12/2013 Thompson ..... B05B 9/0894 239/152
8,962,094 B2 * 2/2015 Taylor ..... B05B 7/26 427/455
9,027,505 B2 * 5/2015 Yanagawa ..... B05B 12/20 118/301
9,067,221 B2 * 6/2015 Gopalan ..... F15B 21/12
9,067,236 B2 * 6/2015 Gould ..... B01F 25/4331
9,089,869 B2 * 7/2015 Galvin ..... E04D 15/00
9,168,554 B2 * 10/2015 Saine ..... B05B 15/50
9,174,234 B2 * 11/2015 Snowwhite ..... E04D 15/00
9,227,184 B2 * 1/2016 Nakano ..... B05B 1/14
9,233,389 B2 * 1/2016 Grueter ..... H01L 24/743
9,233,825 B2 * 1/2016 Madigan ..... A61F 6/005
9,242,267 B2 * 1/2016 O'Leary ..... B29B 7/7409
9,377,115 B2 * 6/2016 Frick ..... F16K 17/0493
9,446,422 B2 * 9/2016 Jones ..... B05B 15/40
9,517,479 B2 * 12/2016 Hines ..... F04B 53/16
9,566,594 B2 * 2/2017 Galvin ..... B05B 9/007
9,573,150 B2 * 2/2017 Snowwhite ..... B05C 5/0279
9,573,159 B2 * 2/2017 McGuffey ..... B05C 5/025
9,604,234 B2 * 3/2017 Thompson ..... F04B 1/145
9,604,235 B2 * 3/2017 Thompson ..... F04B 1/14
9,610,604 B2 * 4/2017 Galvin ..... B05B 9/007
9,636,693 B2 * 5/2017 Nakano ..... B01J 37/0215
9,682,392 B2 * 6/2017 Adams ..... A61F 13/49017
9,694,372 B2 * 7/2017 Taylor ..... B05D 1/02
9,771,691 B2 * 9/2017 Howseman, Jr. ..... E01C 11/24
9,815,080 B2 * 11/2017 Carmichael ..... B05C 11/1047
9,844,795 B2 * 12/2017 Hoard ..... B05C 5/0216
9,849,469 B2 * 12/2017 Nakano ..... B01J 37/0215
9,873,132 B2 * 1/2018 Dangler ..... H01L 21/67253
9,878,337 B1 * 1/2018 Hong ..... B05B 7/0075
9,889,599 B2 * 2/2018 Ayers ..... B29C 66/91423
9,901,720 B2 * 2/2018 Kurosaki ..... A61M 25/1029
9,908,137 B2 * 3/2018 Lessley ..... B05C 5/0245
9,914,141 B2 * 3/2018 Thompson ..... F04B 23/02
9,914,147 B2 * 3/2018 Harris ..... B05C 5/0279
9,931,665 B2 * 4/2018 Cheung ..... B05C 11/1036
10,010,911 B2 * 7/2018 Bamford ..... B24B 5/423
10,040,092 B2 * 8/2018 Saine ..... B05C 11/1007
10,046,352 B2 * 8/2018 Saine ..... B05D 1/02
10,064,325 B2 * 9/2018 Grimm ..... A01C 23/007
10,124,303 B2 * 11/2018 Britcher ..... B05C 9/10
10,124,362 B2 * 11/2018 Saine ..... B05D 1/265
10,130,959 B1 * 11/2018 Xiao ..... B05B 1/18
10,184,590 B2 * 1/2019 Krutzen ..... F16L 58/181
10,201,844 B2 * 2/2019 Nishinaka ..... B21D 28/145
10,239,087 B2 * 3/2019 Galvin ..... B05C 17/00553
10,265,708 B2 * 4/2019 Rhea ..... A61M 39/287
10,272,464 B2 * 4/2019 Saine ..... B05C 5/0225
10,278,921 B2 * 5/2019 Quam ..... B05C 5/0237
10,421,288 B2 * 9/2019 Murayama ..... B41J 2/185
10,464,098 B2 * 11/2019 Saine ..... B05B 7/16
10,471,461 B2 * 11/2019 Ganzer ..... B05C 17/015
10,486,958 B1 * 11/2019 Hryckowian ..... B05C 11/1002
10,500,606 B2 * 12/2019 Ikagawa ..... B05C 5/02
10,518,552 B2 * 12/2019 Murayama ..... B41J 2/17596
10,518,988 B1 * 12/2019 Hryckowian ..... B67D 7/645
10,537,913 B2 * 1/2020 Birecki ..... B05C 5/025
10,555,905 B2 * 2/2020 Quam ..... B05B 7/1666
10,562,062 B2 * 2/2020 Dobizl ..... F16J 15/3436
10,610,882 B2 * 4/2020 Saine ..... B05B 11/3049
10,639,669 B2 * 5/2020 Woodlief ..... B05C 11/1042
10,667,463 B2 * 6/2020 Grimm ..... B05B 15/40
10,695,779 B2 * 6/2020 Saine ..... B05C 11/1002
10,722,909 B1 * 7/2020 Waelder ..... B05B 7/0408
10,744,524 B2 * 8/2020 Lessley ..... B05C 5/0279
10,758,934 B2 * 9/2020 Saine ..... B05C 11/1044
10,807,114 B2 * 10/2020 Saine ..... D06B 3/045
10,856,464 B2 * 12/2020 Schrader ..... A01C 23/024
10,919,060 B2 * 2/2021 Thompson ..... F04B 1/145
10,974,264 B2 * 4/2021 Haydell ..... B01D 53/26
11,007,790 B2 * 5/2021 Murayama ..... B41J 2/17596
11,041,745 B2 * 6/2021 Fort ..... G01F 1/56
11,045,826 B2 * 6/2021 Matlack ..... B05B 14/30
11,110,483 B2 * 9/2021 Ganzer ..... B05C 5/001
11,167,310 B2 * 11/2021 Clark ..... F21V 15/01
11,229,923 B2 * 1/2022 Ikushima ..... H01L 21/6715
11,235,890 B1 * 2/2022 Dahlstrom ..... B64D 47/08
11,255,053 B2 * 2/2022 Vizcaino ..... C09D 7/40
11,298,717 B2 * 4/2022 Fritz ..... B05B 13/0452
11,344,909 B2 * 5/2022 Saine ..... B05C 11/025
2003/0131791 A1 * 7/2003 Schultz ..... B05C 5/0275 427/422
2003/0168180 A1 * 9/2003 Saidman ..... B05C 5/001 222/146.2
2004/0154531 A1 * 8/2004 Bruns ..... B05C 5/027 118/300
2004/0237886 A1 * 12/2004 Meissner ..... B05C 5/0279 118/506
2005/0241755 A1 * 11/2005 Daher ..... B05C 11/1047 118/313
2006/0086820 A1 * 4/2006 Byers ..... B05B 15/40 239/106
2007/0125877 A1 * 6/2007 Zillig ..... B05C 11/1036 239/290
2008/0110940 A1 * 5/2008 Frates ..... B05C 5/0237 222/504
2011/0014430 A1 1/2011 McGuffey
2015/0028059 A1 * 1/2015 O'Leary ..... B05C 17/00516 222/23
2015/0108254 A1 4/2015 Commette et al.
2015/0267696 A1 * 9/2015 Kingsford ..... F04B 53/10 29/592.1
2016/0166441 A1 6/2016 Adams et al.
2016/0175876 A1 * 6/2016 Choiniere ..... B05C 11/1036 222/1
2016/0256889 A1 * 9/2016 Jones ..... B05C 5/0279
2016/0332186 A1 * 11/2016 Richards ..... E01C 11/005
2017/0128968 A1 * 5/2017 Adams ..... B05B 13/0207
2018/0147597 A1 * 5/2018 Harris ..... B05C 5/0279
2018/0353980 A1 * 12/2018 Van Rijn ..... B05B 1/14
2019/0151872 A1 * 5/2019 Schroer ..... B05C 17/002
2019/0201922 A1 * 7/2019 Haydell ..... B01D 53/26
2019/0217312 A1 * 7/2019 Rhea ..... A61M 39/287
2019/0358659 A1 * 11/2019 Schulze ..... B05C 11/1002

(56) References Cited

U.S. PATENT DOCUMENTS

| | | | | |
|---|---|---|---|---|
| 2020/0070194 | A1* | 3/2020 | Williams | B05B 1/14 |
| 2020/0197963 | A1* | 6/2020 | Takahashi | B05B 15/40 |
| 2020/0253184 | A1* | 8/2020 | Glasbrenner | B05B 12/1418 |
| 2020/0267893 | A1* | 8/2020 | Grimm | A01C 23/008 |
| 2021/0096012 | A1* | 4/2021 | Reuter | B05C 11/1002 |
| 2021/0100159 | A1* | 4/2021 | Schrader | A01C 23/007 |
| 2021/0162439 | A1* | 6/2021 | Thompson | F04B 9/045 |
| 2021/0228822 | A1* | 7/2021 | Dunne | B05B 11/0054 |
| 2021/0285804 | A1* | 9/2021 | Fort | G01F 15/185 |
| 2021/0299687 | A1* | 9/2021 | Fideler | B05B 1/3046 |
| 2021/0323007 | A1* | 10/2021 | Matlack | B05B 12/1472 |
| 2021/0363702 | A1* | 11/2021 | Vizcaino | E01B 31/26 |
| 2021/0370328 | A1* | 12/2021 | Fideler | B05B 15/40 |
| 2022/0040725 | A1* | 2/2022 | Fliess | B05C 11/1042 |
| 2022/0048062 | A1* | 2/2022 | Shin | B05C 5/0279 |
| 2022/0062922 | A1* | 3/2022 | Ferren | A01M 7/0089 |
| 2022/0062934 | A1* | 3/2022 | Ferren | G06K 9/00536 |
| 2022/0062939 | A1* | 3/2022 | Ferren | B01D 29/64 |
| 2022/0062940 | A1* | 3/2022 | Ferren | B05B 15/55 |
| 2022/0064878 | A1* | 3/2022 | Sutton | E01C 11/005 |
| 2022/0072263 | A1* | 3/2022 | Novkov | A61M 16/1095 |
| 2022/0072568 | A1* | 3/2022 | Coplin | B05B 12/02 |
| 2022/0072569 | A1* | 3/2022 | Coplin | B05B 1/34 |
| 2022/0105480 | A1* | 4/2022 | Saidman | B05B 15/58 |
| 2022/0105481 | A1* | 4/2022 | Burkley | G01N 9/02 |
| 2022/0105482 | A1* | 4/2022 | des Jardins | B05B 15/65 |
| 2022/0168769 | A1* | 6/2022 | Rodrigues | B05B 12/149 |
| 2022/0258201 | A1* | 8/2022 | Burmester | B05B 15/40 |

OTHER PUBLICATIONS

International Search Report issued by ISA/EPO in connection with PCT/US2019/060297 dated May 8, 2020.

International Preliminary Report on Patentability issued by ISA/EPO in connection with PCT/US2019/060297 dated May 11, 2021.

* cited by examiner

MODULAR FLUID APPLICATION DEVICE FOR VARYING FLUID COAT WEIGHT

This is a National Stage Application of International Patent Application No. PCT/US19/60297, filed Nov. 7, 2019, which claims the benefit of and priority to Provisional U.S. Patent Application Ser. No. 62/758,078, filed Nov. 9, 2018, the entireties of which are incorporated fully herein by reference.

BACKGROUND

Known fluid application devices are used in the manufacture of various articles including disposable hygiene products. In general, the known fluid application devices are configured to discharge hot melt adhesive onto a component of the disposable hygiene product, such as a shell layer or strands of elasticated material. The elasticated material may be used, for example, in leg elastics, waist elastics and cuff elastics of the disposable hygiene product.

The known fluid application devices are constructed differently depending on a particular application, for example, contact or non-contact strand coating, spray, or slot die coating applications. For example, the known fluid application devices require different nozzle types or configurations for certain applications. In addition, some applications require air to be discharged from the nozzle to act on the discharged hot melt adhesive, thereby controlling an application pattern of the adhesive, or that air be introduced within the nozzle for discharging the hot melt adhesive from the nozzle as a spray.

Some known fluid application devices are also configured to vary a coat weight of the fluid to be applied on the component. For example, in a fluid application device having a slot die assembly, separate inlet ports and associated passageways and discharge ports may be provided to allow for multiple flows of the hot melt adhesive to be individually controlled. Accordingly, a first coat weight of hot melt adhesive may be applied from one discharge port, and an add-on coat weight may be selectively applied to the first coat weight from a second discharge port.

In a known strand coating application, known fluid application devices include a metering device having a plurality of gear pumps mounted directly on a manifold of an applicator head. The metering device is configured to receive the hot melt adhesive from a remote supply source and meter the hot melt adhesive to individual nozzles, individual nozzle orifices, or individual valve modules to provide different volumes of the hot melt adhesive to the nozzle. However, such a fluid application device does not include preheated air, and thus, may be limited in the number of application patterns that can be produced.

Further, in some known fluid application devices, an application pattern of the hot melt adhesive, for example, a stitch-type pattern (e.g., an on-off-on-off pattern), may be limited by the on-off cycle time of the valve. For example, with an elasticated strand moving at a constant line speed, the minimum distance between hot melt applications on the strand is dependent upon the length of time required for a valve of the module to move from an open position to a closed position, and then return to the open position. In known fluid application devices, the on-off cycle time is around 6 ms. Thus, to reduce a length of hot melt adhesive application and/or gaps between the adhesive when applying the adhesive in a stitch pattern, the line speed of the strand must be reduced, thereby increasing manufacturing time and reducing output.

A manufacturer typically uses different applicator equipment for the various applications above, which may result in high equipment costs, significant amounts of time where equipment is not being utilized, and a reduction in available floor space in a manufacturing facility.

Accordingly, it is desirable to provide a fluid application device that may be configured to selectively provide heated air, allow different fluid coat weights, and interchangeably accept nozzles of different configurations, including slot die assemblies and laminated plate nozzles, for different applications. It is also desirable to reduce on-off cycle time, thereby increasing the number of possible application patterns and/or allowing for increased line speeds.

SUMMARY

According to one aspect, a modular fluid application device includes a module base and first and second fluid passageways extending within the module base and intersecting to form a nozzle fluid supply passageway. The modular fluid application device also includes a fluid outlet formed on a nozzle mounting surface of the module base fluidically connected to the nozzle fluid supply passageway, a base air passageway extending in the module base and an air outlet formed on the nozzle mounting surface fluidically connected to the base air passageway. A first module bank is removably mounted on the module base and includes at least one first module having a first valve configured to control a flow of fluid in the first fluid passageway. A second module bank is removably mounted on the module base and includes at least one second module having a second valve configured to control a flow of fluid in the second fluid passageway. The first module and the second module are mounted at an angle relative to one another.

The modular fluid application device may further include a filter block removably secured and fluidically connected to the module base. The filter block may include first and second fluid supply inputs and first and second filters fluidically connected to the first and second fluid supply inputs, respectively, such that the first and second filters are configured to receive the fluid from respective first and second fluid supply inputs. The first module may be fluidically connected to the first filter to receive the fluid from the first filter, and the second module may be fluidically connected to the second filter to receive the fluid from the second filter.

The modular fluid application device may further include an air preheater removably secured and fluidically connected to the module base. The air preheater may include and air supply inlet, one or more heating elements configured to heat air received through the air supply inlet, an air passageway configured to receive the heated air and an air preheater outlet for discharging the air from the air preheater. The one or more heating elements may be spiral heaters. The base air passageway may be fluidically connected to the air preheater to receive air from air preheater.

The modular fluid application device may further include a nozzle removably mounted and fluidically connected to the module base on the nozzle mounting surface. The nozzle may include a front plate, a backing plate and a plurality of laminated nozzle plates secured therebetween. The nozzle may be configured to receive the air and the fluid from the module base.

The first module and the second module may be operable to provide a first operating state in which the first valve is open and the second valve is closed to provide a first volume of fluid to the nozzle, a second operating state in which the first valve is closed and the second valve is open to provide a second volume of fluid to the nozzle, a third operating state in which the first valve is open and the second valve is open to provide a sum of the first volume and the second volume of fluid to the nozzle, and a fourth operating state in which the first valve is closed and the second valve is closed to substantially prevent the fluid from flowing to the nozzle.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 2:
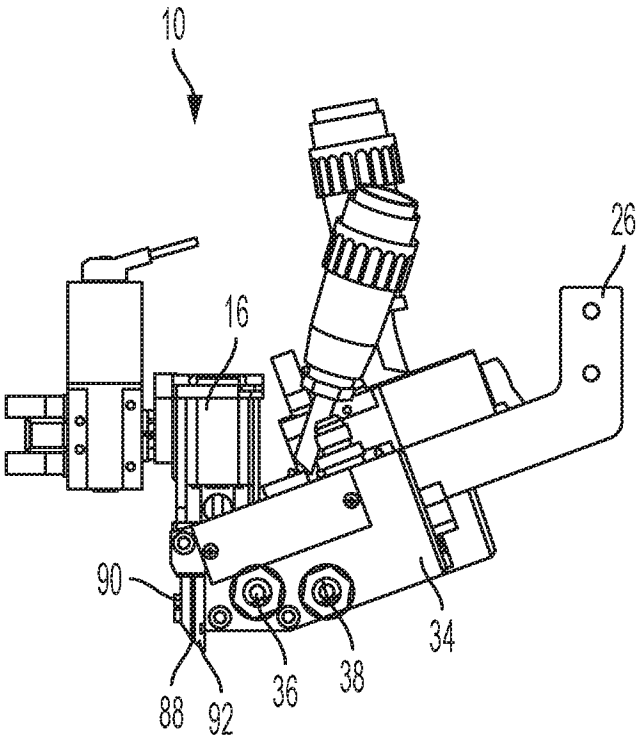
FIG. 2 is a side view of the modular fluid application device of FIG. 1.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 1:
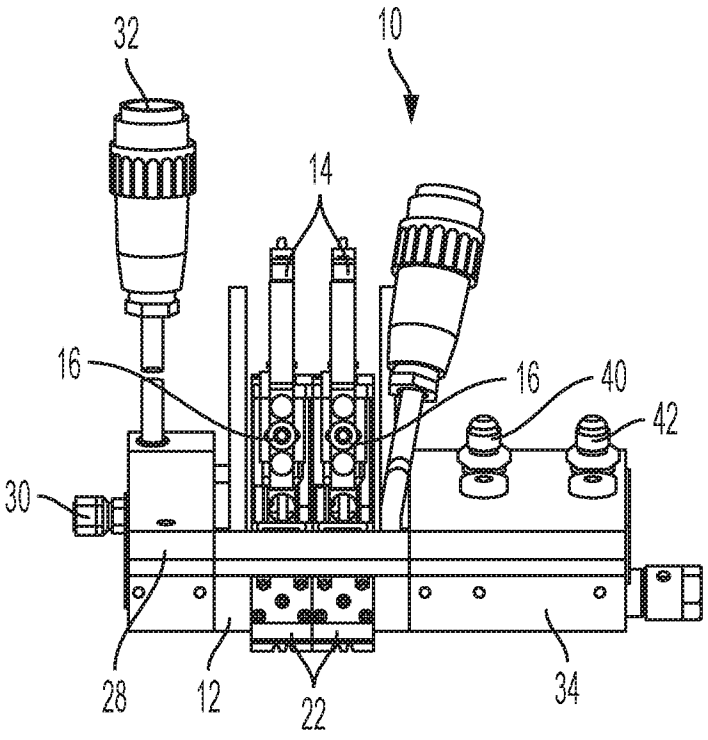
FIG. 1 is a front view of a modular fluid application device according to an embodiment.
Figure 3:
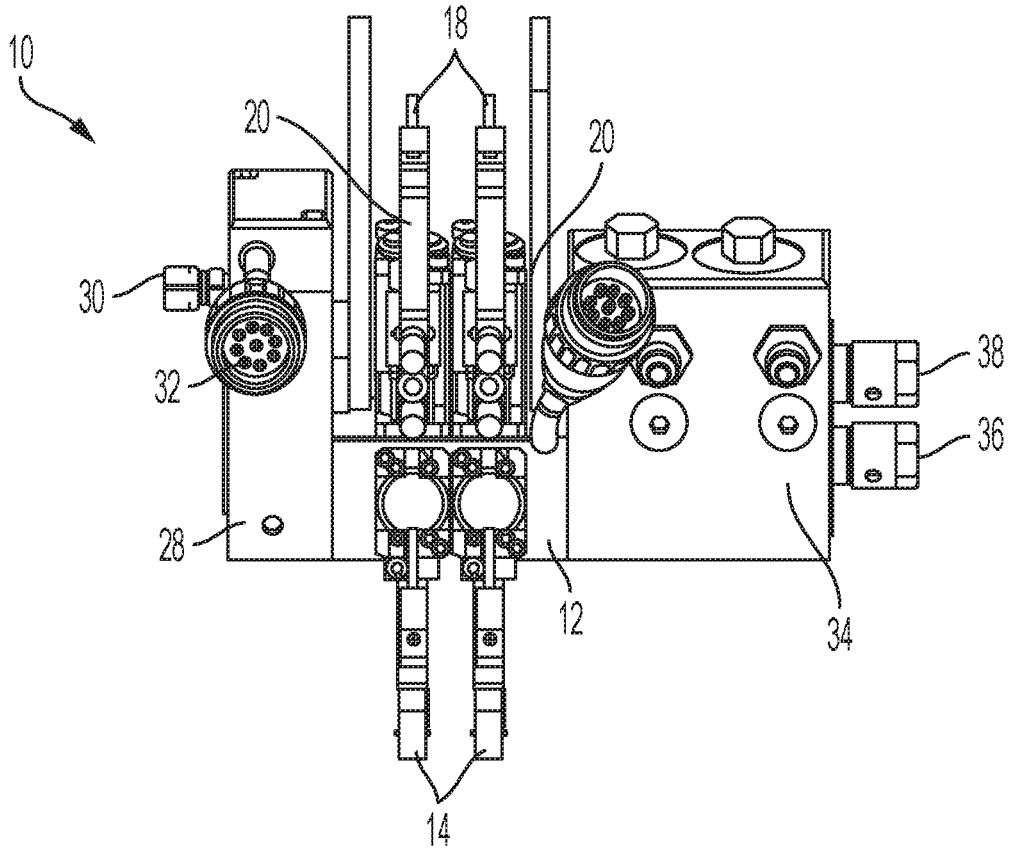
FIG. 3 is a top view of the modular fluid application device of FIG. 1.

FIG. 1 is a front view of a modular fluid application device 10, according to an embodiment, FIG. 2 is a side view of the modular fluid application device 10 of FIG. 1, and FIG. 3 is a top view of the modular fluid application device 10 of FIG. 1. The modular fluid application device 10 includes a module base 12 and a first module bank 14 removably mounted on the module base 12 having one or more first modules 16. The modular fluid application device 10 also includes a second module bank 18 removably mounted on the module base 12 having one or more second modules 20. One or more nozzles 22 may be releasably secured to a nozzle mounting surface 24 (see FIG. 4) of the module base 12 with a suitable fastener (not shown). A suitable fastener includes, for example, a bolt configured to extend through the nozzle 22 for receipt in a corresponding opening of the module base 12. The modular fluid application device 10 may also include one or more mounting brackets 26 for mounting to a support (not shown). In one embodiment, the modules 16, 20 are fluidically connected to the module base 12.

In one embodiment, the modular fluid application device 10 includes an air preheater 28 removably secured to the module base 12. The air preheater 28 includes an air supply inlet 30 connected to an air supply (not shown). A preheater power connection 32 is configured for connection to a power source (not shown).

In addition, the modular fluid application device 10 may include a filter block 34 removably secured to the module base 12. In one embodiment, the filter block 34 includes a first fluid supply input 36 and a second fluid supply input 38, each configured to receive a fluid, such as a hot melt adhesive, from one or more remotely positioned fluid supplies (not shown). In one embodiment, the first and second fluid inputs 36, 38 may each be connected to the one or more fluid supplies by a flexible supply hose (not shown). In one embodiment, the same fluid is received by the first and second fluid supply inputs 36, 38. Thus, in one embodiment, the fluid may be provided to the modular fluid application 10 as two separate, discrete flows.

The filter block 34 may also include a first filter 40 fluidically connected to the first fluid supply input 36 and configured to receive the fluid from the first fluid supply input 36. The filter block 34 may further include a second filter 42 fluidically connected to the second fluid supply input 38 and configured to receive the fluid from the second fluid supply input 38.

Figure 4:
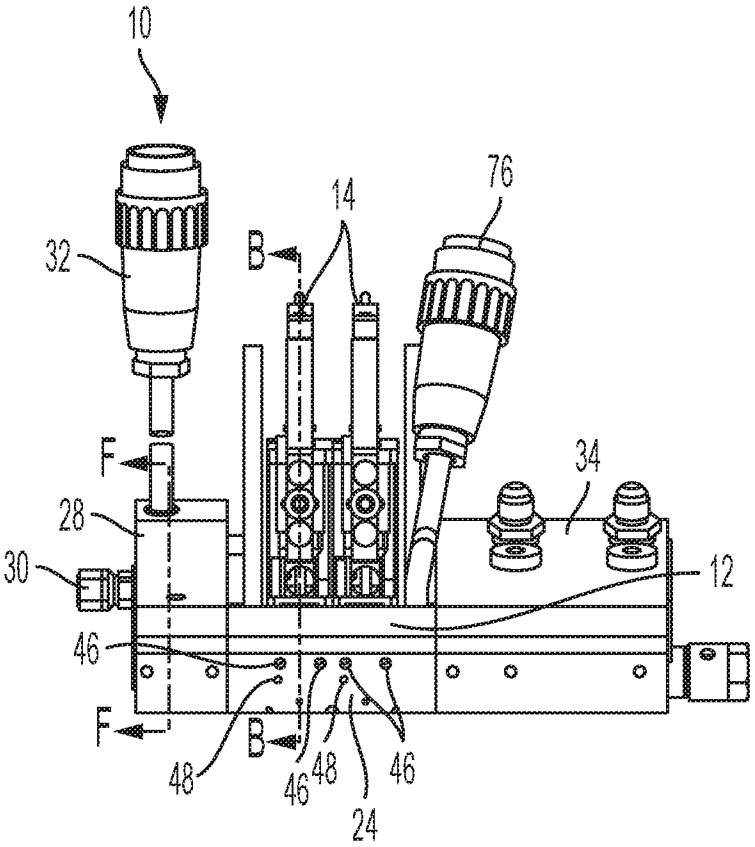
FIG. 4 is a front view of the modular fluid application device of FIG. 1 with nozzles removed, according to an embodiment.

FIG. 4 is another front view of the modular fluid application device 10, according to an embodiment, with the nozzle(s) 22 removed from the nozzle mounting surface 24. As can be seen in FIG. 4, the nozzle mounting surface 24 is formed with one or more fluid outlets 46 through which the fluid may be discharged from the module base 12 for receipt in corresponding nozzle inlets (not shown) of the one or more nozzles 22. The nozzle mounting surface 24 may further be formed with one or more air outlets 48 though which air may be discharged from the module base 12 for receipt in corresponding nozzle air inlets (not shown) of the one or more nozzles 22. In this manner, a nozzle 22 of the one or more nozzles may be fluidically connected to the module base 12 to receive the fluid, such as a hot melt adhesive, and air, such as the preheated air, from the module base 12.

Figure 5:
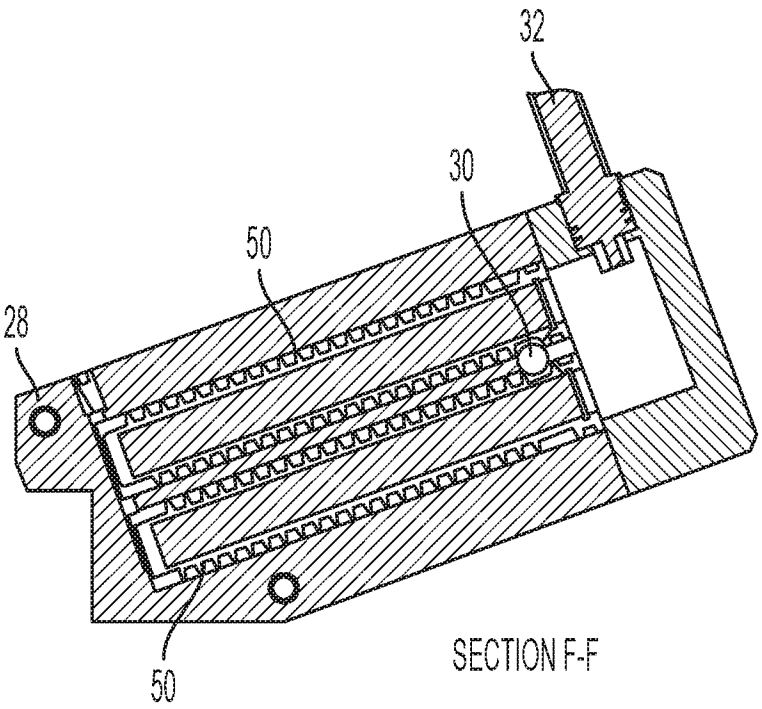
FIG. 5 is a cross-sectional view of the modular fluid application device taken at F-F of FIG. 4, according to an embodiment.

FIG. 5 is a cross-sectional view taken at F-F in FIG. 4, showing a cross section of the air preheater 28. In one embodiment, the air preheater 28 may include one or more heating elements 50 configured to preheat air received in the air preheater 28 via the air supply inlet 30. The one or more heating elements 50 may be, for example spiral heating elements. The heating elements 50 may be powered by way of the power connection 32.

Figure 7:
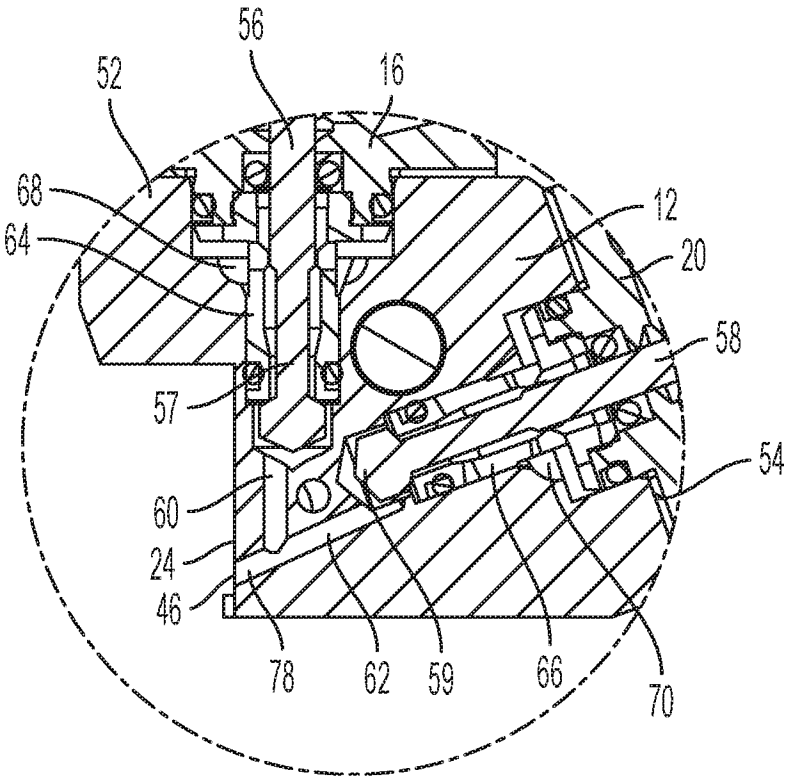
FIG. 7 is an enlarged view of a portion the modular fluid application device taken at detail C of FIG. 4, according to an embodiment.
Figure 6:
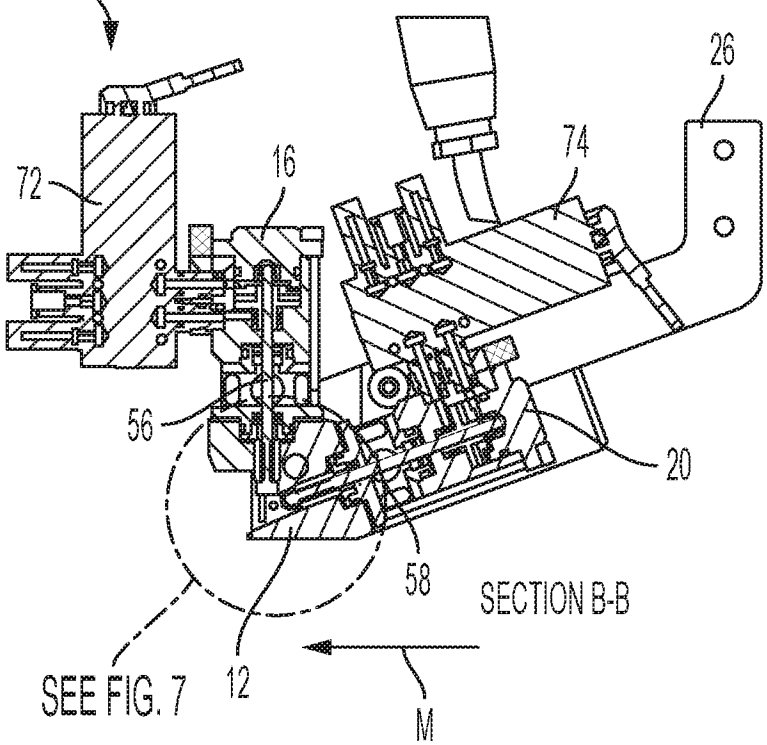
FIG. 6 is a cross-sectional view of the modular fluid application device taken at B-B of FIG. 4, according to an embodiment.

FIG. 6 is a cross-sectional view of the modular fluid application device 10 taken at B-B in FIG. 4, and FIG. 7 is an enlarged view showing a portion of the modular fluid application device 10, taken at detail C in FIG. 6. In one embodiment, a first module 16 of the first module bank 14 and a second module 20 of the second module bank 18 may be removably mounted on the module base 12 at an angle relative to one another with respect to a machine direction 'M' for example, to extend in a non-parallel relationship. Accordingly, the module base 12 may include first and second seats 52, 54 to which the first and second modules 16, 20 are mounted.

The first and second modules 16, 20 may be formed as respective valve modules each including a valve 56, 58 having a valve plug 57, 59 movable between a closed position where fluid flow is restricted or prohibited through the respective first and second fluid passageways 60, 62 and an open position where fluid flow is permitted through the respective first and second fluid passageways 60, 62. In addition, each of the first and second modules 16, 20 either include or form in combination with a portion of the module base 12, first and second inlet chambers 64, 66 in fluid communication with the filter block 34. The first and second inlet chambers 64, 66 are configured to receive the fluid from the first and second filters 40, 42, respectively. In one embodiment, the first inlet chamber 64 is fluidically connected to the first filter 40 by a first module supply passageway 68 and the second inlet chamber 66 is fluidically connected to the second filter 42 by a second module supply passageway 70.

In one embodiment, the first and second modules 16, 20 may include respective first and second solenoids 72, 74 for actuating the valves 56, 58. For example, in one embodiment, the first and second solenoids 72, 74 may be operated to allow for control air to pressurize the modules 16, 20 and move the valves 56, 58, for example, the valve plugs 57, 59 from the closed position to the open position and, in some embodiments, maintain the valves 56, 58 in the open position. Conversely, the solenoids 72, 74 may be operated to allow for control air to pressurize the modules 16, 20 to move the valve 56, 58 and plugs 57, 59 from the open position to the closed position. In one embodiment, the valves 56, 58 may be moved against a biasing force from respective biasing members, such as coil springs, which may hold the valve 56, 58 and plugs 57, 59 in a normally closed or open position as desired. Power may be supplied to the solenoids 72, 74 by a module power connection 76 (FIG. 4).

The first and second fluid passageways 60, 62 may extend in one or both a respective module 16, 20 and the module base 12. In one embodiment, the first and second fluid passageways 60, 62 intersect downstream from the first and second valve modules 16, 20 to form one or more nozzle fluid supply passageways 78. The nozzle fluid supply passageway(s) 78 fluidically connected to a corresponding fluid outlet 46 on the nozzle mounting surface 24. In one embodiment, each valve module 16, 20 may control fluid flow to two nozzle fluid supply passageways 78.

Figure 9:
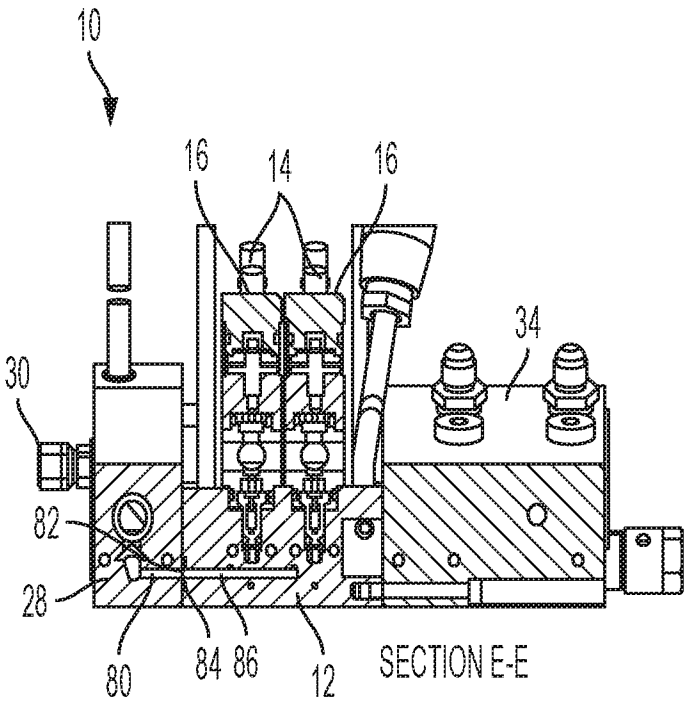
FIG. 9 is a cross-sectional view of the modular fluid application device taken at section E-E of FIG. 8, according to an embodiment.
Figure 8:
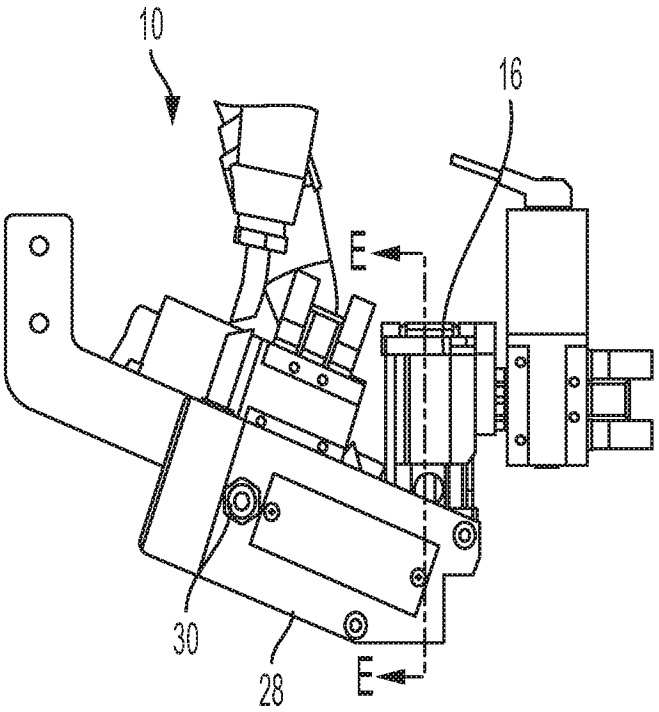
FIG. 8 is another side view of the modular fluid application device of FIG. 4, according to an embodiment.

FIG. 8 is another side view of the modular fluid application device 10 according to an embodiment, and FIG. 9 is a cross-sectional view of the modular fluid application device 10 taken at E-E in FIG. 8, according to an embodiment. In one embodiment, the air preheater 28 is fluidically connected to the module base 12 such that the preheated air may be received in the module base 12 from the air preheater 28. For example, in one embodiment, the air preheater 28 includes an air passageway 80 extending between the one or more heating elements 50 and an air preheater outlet 82 on a surface of the air preheater 28. The module base 12 may include a base air inlet 84 positioned relative to the air preheater outlet 82 to receive the air from the air preheater 28. A base air passageway 86 extends in the module base 12 from the base air inlet 84 to one or more air outlets 48 on the nozzle mounting surface 24 (FIG. 4). The one or more air outlets 48 are fluidically connected to the base air passageway 86 so that the air may be discharged from the one or more air outlets 46 for receipt in the nozzle 22.

According to the embodiments herein, the first module 16 and the second module 20 may be operated by moving the valves 56, 58 between open and closed positions to provide respective volumes (i.e. volume flow rates) of the fluid to the one or more nozzles 22. In one embodiment, the volume of the fluid provided to the nozzle 22 by each module 16, 20 is dependent upon a volume flow rate of the fluid provided to the module from first and/or second metering devices (not shown), which may be positioned remotely and upstream from the filter block 34. In one embodiment, the first metering device may provide the fluid to the first module 16, via the filter block 34 and first filter 40, at a first volume, and the second metering device may provide the fluid to the second module 20, via the filter block 34 and second filter 42, at a second volume. The first volume and the second volume may be controlled by the metering devices, and may be equal to, or different from one another. Accordingly, the first module 16 and the second module 20 may provide equal or different volumes of the fluid to the nozzle 22 depending on a desired application.

In the manner above, different operating states in which different volumes (i.e., volume flow rates) of the fluid are discharged from the nozzle 22 may be realized. For example, in a first operating state, the first module 16 may be open and the second module 20 may be closed to provide the first volume of the fluid to the nozzle 22. In a second operating state, the first module 16 maybe closed and the second module 20 may be open to provide the second volume of fluid to the nozzle 22. In a third operating state, the first module 16 and the second module 20 may both be open to provide the sum of the first volume and the second volume of fluid to the nozzle 22. In a fourth operating state, the first module 16 and the second module 20 may both be closed to substantially prevent the fluid from being delivered to the nozzle 22. In one embodiment, the modular fluid application device 10 may switch between operating states in a predetermined manner to discharge the fluid at a desired coat weight and/or stitch pattern. Fluid provided to the nozzle may be discharged for application onto a substrate, such as a strand or layer of material, substantially according to the volume at which the fluid was provided to the nozzle.

Referring again to FIGS. 1 and 2, in one embodiment, the nozzle 22 may be a laminated plate (LP) nozzle comprising a plurality of nozzle plates 88 secured between a face plate 90 and a backing plate 92. The nozzle 22 is configured to receive the fluid and the air from the module base 12 through the backing plate and direct the fluid and air through nozzle 22 for discharge and application on a strand of material. In one embodiment, the air is discharged in a manner which causes the fluid to oscillate or vacillate, and in turn, to be applied on the strand in a non-linear pattern.

However, the present disclosure is not limited to the nozzle 22 described above and shown in FIG. 1. For example, in one embodiment, the nozzle may be a spray nozzle in which the air and fluid are supplied to a common channel thereby causing the fluid to be sprayed in an atomized or droplet form. In some embodiments, the nozzle 22 and/or the plurality nozzle plates 88 may be formed as a unitary structure, instead of a laminated structure, for example, using known machining processes or additive manufacturing.

In one embodiment, the nozzle may be a LP nozzle configured for use in contact strand coating applications which may be performed without supplying air to the nozzle. Thus, in one embodiment, the modular fluid application device 10 may be assembled without the air preheater 28, or operated without supplying preheated air to the nozzle 22, for applications in which preheated air is not used.

In another embodiment, the nozzle may be a slot die assembly configured for substrate coating applications. The slot die assembly may include an adapter, a front plate, and a shim package secured therebetween in a manner which will be appreciated by those having skill in the art. The shim package may include a plurality of shims, one or more of which may include a discharge slot for discharging the fluid.

Such a slot die assembly does not require preheated air. Accordingly, the modular fluid application device 10 may be assembled without the air preheater 28, or operated without supplying preheated air to the nozzle 22, for this application as well.

In the embodiments above, different fluid coat weights may be provided in the first, second, third and fourth operation states. However, in an embodiment where different fluid coat weights are not desired, the filter block 34 may be replaced with a conventional single inlet filter block (not shown) configured to receive a single supply or flow of fluid at a predetermined flow rate and provide the single supply of fluid to a module for controlling flow of the fluid to the nozzle 22. Alternatively, the filter block 34 described herein may be used while receiving a fluid flow into only one of the fluid inputs 36, 38, and/or maintaining one valve 56, 58 in the closed condition while operating the other valve 56, 58 to control the single flow of fluid to the nozzle 22.

According to an embodiment described herein, the fluid may be received in the filter block 34 as at least two separate and discrete flows through the first and second supply inputs 36, 38. The fluid may be maintained as separate and discrete flows through the filter block 34, the first and second modules 16, 20 and into the module 12. In one embodiment, the separate flows of the fluid may be combined in the nozzle fluid supply passageway 78 or controlled to flow alternately in the nozzle fluid supply passageway 78 based on operation of the valves 56, 58 in the first and second modules 16, 20. In another embodiment, the single fluid flow may be provided to the modular fluid application device 10 and be split into two or more fluid flows by way of a manifold (not shown).

Moreover, in the embodiments above, the first and second modules 16, 20 may be operated to reduce an on-off cycle time compared to a conventional fluid application device in which a single module controls fluid flow to a nozzle. For example, in the embodiments above, the first and second modules 16, 20 may be operated simultaneously such that one of the modules 16, 20 may be moving to the open position while the other of the modules 16, 20 is moving to the closed position, thereby reducing the length of a time period in which fluid is not provided to the nozzle 22. Accordingly, in one embodiment, a line speed of a substrate, such as an elasticated strand, may be increased compared a line speed of the same in a conventional single module fluid application device, while maintaining or reducing a length of a stitch application pattern (e.g., an on-off-on-off . . . application pattern). Moreover, the modular fluid application device 10 described herein may be operated to apply the fluid on a substrate, such as a strand or layer of material, at a variety of different coat weights without modifying the construction modular fluid application device 10. Rather, the coat weights may be modified by operating the first and second modules 16, 20, while maintaining the ability to operate at the reduced on-off cycle times.

In one embodiment, the first and second modules 16, 20 may be operably connected to a controller configured to control operation of the valves 56, 58, for example, by operating the solenoids 72, 74. The controller may include a processor, such as a microprocessor, and a memory configured to store program instructions relating to the operation of the modules 16, 20. The processor may execute the program instructions and control operation of the valves 56, 58 and the solenoids 72, 74 according to the program instructions. The controller may also include an input/output unit configured to allow for information, signals, instructions, communications and the like to be received by and/or transmitted from the controller.

The modular fluid application device 10 described in the embodiments above may be used to apply a fluid, such as a hot melt adhesive, onto a strand of material (including elasticated strands) or a layer of material, such as a barrier or shell layer. Such an application may be useful in the manufacture of nonwoven products including disposable hygiene products. However, the present disclosure is not limited thereto. It is understood that the fluid application device described herein may be used in other applications as well, for example, packaging.

In the embodiments above, various features from one embodiment may be implemented in, used together with, or replace other features in different embodiments as suitable.

All patents referred to herein, are hereby incorporated herein in their entirety, by reference, whether or not specifically indicated as such within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

The invention claimed is:

1. A modular fluid application device comprising:

a module base;

a first fluid passageway extending within the module base;

a second fluid passageway extending within the module base and intersecting the first fluid passageway to form a nozzle fluid supply passageway downstream from the first and second fluid passageways;

a fluid outlet formed on a nozzle mounting surface of the module base and fluidically connected to the nozzle fluid supply passageway;

a base air passageway extending in the module base;

an air outlet formed on the nozzle mounting surface and fluidically connected to the base air passageway;

a first module bank removably mounted on the module base, the first module bank comprising at least one first module having a first valve configured to control a flow of fluid in the first fluid passageway;

a second module bank removably mounted on the module base, the second module bank comprising at least one second module having a second valve configured to control a flow of fluid in the second fluid passageway; and a filter block removably secured and fluidically connected to the module base, wherein the filter block comprises first and second fluid supply inputs and first and second filters fluidically connected to the first and second fluid supply inputs, respectively, such that the first and second filters are configured to receive the fluid from respective first and second fluid supply inputs, wherein the first module and the second module are mounted at an angle relative to one another.

2. The modular fluid application device of claim 1, wherein the first module is fluidically connected to the first filter and is configured to receive the fluid from the first filter, and the second module is fluidically connected to the second filter and is configured to receive the fluid from the second filter.

3. The modular fluid application device of claim 1, further comprising an air preheater removably secured and fluidically connected to the module base.

4. The modular fluid application device of claim 3, wherein the air preheater comprises and air supply inlet, one or more heating elements disposed within the air preheater configured to heat air received through the air supply inlet, an air passageway configured to receive the heated air and an air preheater outlet for discharging the air from the air preheater.

5. The modular fluid application device of claim 4, wherein the one or more heating element is a spiral heater.

6. The modular fluid application device of claim 4, wherein the base air passageway is fluidically connected to the air preheater and is configured to receive air from air preheater.

7. The modular fluid application device of claim 1, further comprising a nozzle removably mounted and fluidically connected to the module base on the nozzle mounting surface.

8. The modular fluid application device of claim 7, wherein the nozzle comprises a front plate, a backing plate and a plurality of laminated nozzle plates secured therebetween.

9. The modular fluid application device of claim 8, wherein the nozzle is configured to receive the air and the fluid from the module base.

10. The modular fluid application device of claim 7, wherein the first module and the second module are operable to provide:

a first operating state in which the first valve is open and the second valve is closed to provide a first volume of fluid to the nozzle;

a second operating state in which the first valve is closed and the second valve is open to provide a second volume of fluid to the nozzle;

a third operating state in which the first valve is open and the second valve is open to provide a sum of the first volume and the second volume of fluid to the nozzle; and a fourth operating state in which the first valve is closed and the second valve is closed to prevent the fluid from flowing to the nozzle.

* * * * *